US007037077B2

(12) United States Patent
Oono et al.

(10) Patent No.: US 7,037,077 B2
(45) Date of Patent: May 2, 2006

(54) RADIATOR FAN AND ENGINE COOLING DEVICE USING THE SAME

(75) Inventors: Yoshiaki Oono, Osaka (JP); Masahiro Saito, Osaka (JP)

(73) Assignee: Yanmar Co., Ltd., (JP)

( * ) Notice: Subject to any disclaimer, the term of this patent is extended or adjusted under 35 U.S.C. 154(b) by 151 days.

(21) Appl. No.: 10/491,698

(22) PCT Filed: Oct. 11, 2002

(86) PCT No.: PCT/JP02/10629

§ 371 (c)(1),
(2), (4) Date: Apr. 5, 2004

(87) PCT Pub. No.: WO03/033913

PCT Pub. Date: Apr. 24, 2003

(65) Prior Publication Data

US 2004/0258530 A1 Dec. 23, 2004

(30) Foreign Application Priority Data

Oct. 15, 2001 (JP) ..... 2001-316267

(51) Int. Cl.
*F03B 3/12* (2006.01)

(52) U.S. Cl. ..... 416/169 A; 416/189; 416/195

(58) Field of Classification Search ..... 416/189, 416/190, 195, 196, 196 R, 169 A
See application file for complete search history.

(56) References Cited

U.S. PATENT DOCUMENTS 4,063,852 A * 12/1977 O'Connor ..... 416/228

(Continued)

FOREIGN PATENT DOCUMENTS

JP 53-022946 A1 8/1976

(Continued)

OTHER PUBLICATIONS

International Search Report for PCT/JP02/10629 mailed Dec. 10, 2002.

(Continued)

*Primary Examiner*—Edward K. Look

*Assistant Examiner*—Dwayne J White

(74) *Attorney, Agent, or Firm*—Rader, Fishman & Grauer PLLC

(57) ABSTRACT

Whereas for each propeller blade of a radiator fan, an attachment angle θ1 at a propeller blade base portion, projected onto a plane parallel to an attachment surface of the propeller blades with respect to the boss is set in a range of 35 to 45°, an attachment angle θ2 of a propeller blade tip portion is set in a range of 15 to 22°. Seven propeller blades and a chord length Ct of the propeller blade tip portion, and an outer circumference length π×Df of the propeller blades are set to satisfy a relationship $0.65<7Ct/(\pi\times Df)<0.85$. A tip broadening ratio of the propeller blades is set to within a range Ct/Cb=1.5 to 2.1, based on the chord length Ct at the propeller blade tip portion, and a chord length Cb at the propeller blade base portion. A fan sweep angle θ3 is set in a range of 15 to 25°.

6 Claims, 16 Drawing Sheets

U.S. PATENT DOCUMENTS

| | | | | |
|---|---|---|---|---|
| 4,568,242 | A | 2/1986 | Susa et al. | |
| 5,326,225 | A * | 7/1994 | Gallivan et al. | 416/179 |

FOREIGN PATENT DOCUMENTS

| | | | |
|---|---|---|---|
| JP | 57-083696 | A1 | 5/1982 |
| JP | 07-030327 | U1 | 6/1995 |
| JP | 10-089289 | A1 | 4/1998 |
| JP | 10-258643 | A1 | 9/1998 |
| JP | 2001-193693 | A1 | 7/2001 |
| JP | 2001-227343 | A1 | 8/2001 |

OTHER PUBLICATIONS

International Preliminary Examination Report for PCT/JP02/10629 completed on May 21, 2003.

* cited by examiner

RADIATOR FAN AND ENGINE COOLING DEVICE USING THE SAME

TECHNICAL FIELD

The present invention relates to a radiator fan in which a plurality of propeller blades are mounted onto a boss in order to force an air flow, as well as to an engine cooling device using such a radiator fan. More specifically, the present invention is related to measures for reducing noise while increasing the static pressure efficiency by letting air flow efficiently to an engine room with high airtightness.

BACKGROUND ART

Conventionally, as disclosed in, for example, JP S57-44799A, the strength of such a radiator fan can be maintained while restricting its length in the axial direction, and it can achieve efficient air flow.

However, if an engine is accommodated in an engine room and its radiator is cooled by a radiator fan, then, as shown in FIG. 11, the state of the engine cooling air flow is determined by the intersection point (1) of the conventional fan characteristics (shown as a thin broken line in FIG. 11) and the airflow resistance within a conventional engine room (shown as thick broken line in FIG. 11). And, under these conditions (intersection point (1) in FIG. 11), a relative noise of the radiator fan is determined by the characteristics of the conventional fan, as shown in FIG. 10. In this case, the relative noise (in dB) given on the vertical axis of FIG. 10 is a normalized value of the measured fan noise SL, and is a value that can be determined by $SL-10\times\log(0.624\times P^2\times Q)$, where P(Pa) is the static pressure in the airflow from the radiator fan and $Q(m^3/s)$ is the flow amount, allowing comparison of equivalent flow conditions (static pressure, flow) when comparing fan noise.

Further, the pressure coefficient (dimensionless) of the vertical axis of FIG. 11 is a nondimensionalized value of the static pressure, and can be determined by $P/(0.5\times\pi\times\rho\times(H\times Df)^2)$, where $\rho(kg/m^3)$ is air density, H (1/s) is a fan rotational frequency and Df is a fan diameter. The flow coefficient (dimensionless) on the horizontal axis of FIG. 10 and FIG. 11 is a nondimensionalized value of the flow, and can be calculated by $Q/(0.25\times\pi^2\times H\times Df^3)$. In all following diagrams, the definitions of the relative noise, the pressure coefficient and the flow coefficient are the same, so that they will not be explained further.

In this type of situation, if the airtightness of the engine room is increased to prevent leakage of engine noise to the outside, then, as shown in FIG. 11, there will be a change to the airflow resistance within the engine room, and the intersection point with the characteristic curve of the conventional fan will move from point (1) to point (2). Accordingly, for the fan with the conventional characteristics as given in FIG. 10, although the engine noise is less likely to leak out, relative noise will be increased instead, and with respect to noise on the outside of the engine room, the radiator fan becomes a new source of noise.

Thus, a problem to be solved by the present invention is to provide a radiator fan which can suppress noise generation even when used within an engine room of high airtightness, and an engine cooling device using such a fan.

DISCLOSURE OF INVENTION

To achieve the above object, a radiator fan in which a plurality of propeller blades are attached to a boss, and which forces airflow, is taken as the premise for the solution given by the invention, according to claim 1. And, for the propeller blades, whereas an attachment angle θ1 at a propeller blade base portion projected onto a plane parallel to an attachment surface of the propeller blades with respect to the boss is set in a range of 35 to 45 deg, an attachment angle θ2 at the propeller blade tip portion is set in a range of 15 to 22 deg.

Due to these specific features, each propeller blade is set to the optimum attachment angle θ2 (15 to 22 deg) at the propeller blade tip portion. That is, if the attachment angle θ2 at the propeller blade tip portion is set to an angle greater than 22°, the amount of airflow in the direction of the rotation axis is large, however the flow may easily delaminate. Conversely, if the attachment angle θ2 is less than 15°, delaminated flow will be less likely to occur, but the amount of airflow flowing in the direction of the rotation axis will be less. Consequently, by setting the attachment angle θ2 at the propeller blade tip portion in the range of 15° to 22°, the volume of airflow in the rotation axis direction can be maintained, and the occurrence of delamination reduced.

Further, by setting the attachment angle θ1 at the propeller blade base portion in a range of 35° to 45°, an airflow in the centrifugal direction can be generated, and air received at the propeller base can be guided to the propeller blade tip portion. Consequently, the flow of air necessary for engine cooling can be maintained without flow delamination.

Consequently, even when used in a space (engine room) with high airtightness, static pressure efficiency can be raised, and fan motive power can be kept down. Further, it also becomes possible to devise a reduction in noise due to the fan.

Particularly, in the invention according to claim 2, the structure given below can be considered to increase static pressure efficiency while reducing noise.

That is to say, a number of the propeller blades N, a chord length Ct at the propeller blade tip portion, and an outer circumference length π×Df of the propeller blades are set such as to satisfy a relationship $$0.65<N\times Ct/(\pi\times Df)<0.85,$$

and, a tip broadening ratio of the propeller blades is set to within a range of $$Ct/Cb=1.5 \text{ to } 2.1,$$

based on the chord length Ct at the propeller blade tip portion and a chord length Cb at the propeller blade base portion, and a sweep angle θ3 with respect to a rotation direction of the fan, defined by a line that passes through a rotation axis of the fan and bisects the chord Cb at the propeller blade base portion and a line that passes through the rotation axis of the fan and bisects the chord Ct at the propeller blade tip portion, is set within a range of 15 to 25 deg.

Due to these specific features, the value {N×Ct/(π×Df)} obtained by dividing the product of the number of propeller blades N and the chord length at the propeller blade tip portion Ct by the circumferential length π×Df of the propeller blades can be set to an optimum value. That is, if N×Ct/(π×Df) is smaller than 0.65, then the blade area of the propeller blades will be too small, and air flow volume will be reduced. On the other hand, if N×Ct/(π×Df) is larger than 0.85, the blade area of the propeller blades is large and the static pressure efficiency will be reduced because of mutual interference of air flow from adjacent blades.

Consequently, by setting the value of N×Ct/(π×Df) larger than 0.65 and smaller than 0.85, in addition to ensuring a sufficient propeller blade area, the propeller blade load is reduced and noise reduction can be planned.

Further, since the tip broadening ratio of the propeller blades is set to within a range of 1.5 to 2.1, based on a value (Ct/Cb) obtained by dividing the chord length Ct at the propeller blade tip portion by the chord length Cb at the propeller blade base portion, the area at the propeller blade tip portion is increased over that at the propeller blade base portion, and efficient airflow can be accomplished.

Still further, the sweep angle θ3 with respect to the rotation direction of the fan is set in a range of 15 to 25 deg, which is advantageous in reducing noise.

Consequently, there is more efficient airflow with respect to the space with high airtightness and in addition to being able to further increase the static pressure efficiency, coupled with a reduction of load on the propeller blades, there is the possibility of even better reduction of the noise of the fan.

Particularly, in the invention according to claim 3, as a structure which can be considered to prevent a performance drop due to changes in diameter of the fan, the structure given below can be considered.

That is, of the forward blade edge and the trailing blade edge of the propeller blades, at least the forward blade edge is curved at a substantially constant curvature from the propeller blade base portion through to the propeller blade tip portion.

Due to these specific features, a cut in the fan circumference, necessitated by a change in use or change in diameter, that is, even if it is changed from a large diameter to a small diameter, there will be no worsening of fan performance due to this fan diameter change, and in addition to making it possible to maintain static pressure efficiency with respect to the space with high airtightness, it becomes possible to realize a reduction of the fan noise.

Next, as a use of this radiator fan in an engine cooling device, the following configuration can be considered.

That is to say, in the invention according to claim 4, the fan is accommodated within a fan shroud, which is made by providing an opening covering the fan from an outer side in a radial direction in an end wall, an overlap position at which the fan propeller blade tip portion overlaps the fan shroud wall in the rotation axis direction, is set in a range:

$$-0{,}02<RP/Df<0.08,$$

based on the fan diameter Df and a standard distance RP in the rotation axis direction, of the propeller blade tip portion of the fan, and a gap TC, in a radial direction between the opening in the fan shroud wall and the fan propeller blade tip portion is set to a value that satisfies the relationship:

$$0<TC/Df<0.15$$

based on the fan diameter Df.

Due to these specific features, the overlap position of the propeller blade tip portion of the fan with respect to the fan shroud wall, is set at an optimum value, based on the value (RP/Df) in which a standard distance RP in the axial direction between the fan shroud face, and a median point in the rotation axis direction at the propeller blade tip portion of the fan, is divided by the fan diameter Df. That is, if the overlap position of the propeller blade tip portion (the value of RP/Df) is less than −0.02, the fan is positioned further downstream in the air flow direction than the fan shroud, so the generation of airflow to the fan shroud is more difficult, and the air flow volume is reduced. On the other hand, if the overlap position of the propeller blade tip portion (the value of the division RP/Df) is more than 0.08, the fan, is positioned further upstream in the airflow direction than the fan shroud, so the air within the fan shroud becomes obstructed, and noise is increased due to this interference effect. Consequently, by setting the value of the overlap position (value RP/Df) to larger than −0.02 and smaller than 0.08, in addition to making possible an increase in air volume by the facilitation of the flow of air to the fan shroud, it prevents the interference effect of the air inside the fan shroud, and makes a reduction in noise possible.

And, when the value obtained by dividing a gap TC between the opening and the propeller blade tip portion by the fan diameter Df is greater than 0 and less than 0.15, air is prevented from bypassing from the blade pressure side to the under pressure side, and it becomes possible to effectively increase airflow. Further, vibratory contact between the mutually unconnected fan and fan shroud can be effectively avoided.

Further, in the invention according to claim 5, the fan is accommodated within the fan shroud, which is made by providing the opening covering the fan from an outer side in a radial direction in the end wall, the opening protruding at a substantially right angle from the end wall toward the airflow direction downstream side, the median position in the rotation axis direction of the propeller blade tip portion of the fan is positioned at substantially the same position on the rotation axis as the fan shroud wall, and a protrusion amount LS of the opening in the fan shroud wall is set such as to satisfy a relationship:

$$0<LS/Df<0.1.$$

based on the fan diameter Df.

Due to these specific features, the optimum value of the protrusion amount LS of the opening in the fan shroud is set based on the fan diameter Df. That is to say, if the protrusion amount LS of the opening is too large, in addition to increasing tube resistance and being unable to effectively increase static pressure efficiency, interference of the fan with the periphery of the opening will be more likely, and there is the risk of noise increase. Consequently, by setting the protrusion amount LS of the opening based on the fan diameter Df to larger than 0 and smaller than 0.1, when compared to an engine cooling device with a simple opening in the fan shroud wall (one in which a protrusion amount LS in the opening does not exist), in addition to static pressure efficiency being able to be efficiently increased, it is possible to prevent a noise increase caused by the interference of the fan with respect to the periphery of the opening.

Further, in the invention according to claim 6, the fan is accommodated within a fan shroud, which is made by providing an opening covering the fan from an outer side in a radial direction in an end wall, the opening protruding at a substantially right angle with a curved portion from the end wall toward the airflow direction downstream side, with the median position in the rotation axis direction of a propeller blade tip portion of the fan is positioned at substantially the same position on the rotation axis as the fan shroud wall, and a radius R of the curved portion of the fan shroud wall is set such as to satisfy a relationship:

$$0<R/Df<0.1$$

based on the fan diameter Df.

Due to these specific features, with respect to the opening provided in the airflow direction downstream side with a substantially right angled protruding portion, the air can flow smoothly with a resistance that is reduced by the curved portion of the fan shroud wall, and the fan volume can be increased.

Further, in the invention according to claim 7, the fan is accommodated within a fan shroud, which is made by providing an opening covering the fan from an outer side in a radial direction in an end wall, the opening protruding with a curved portion and a widening diameter from the end wall toward the airflow direction side, the median position in the rotation axis direction of the propeller blade tip portion of the fan is positioned at substantially the same position on the rotation axis as the fan shroud wall, and an angle β defined by the rotation axis of the fan, and an inclined face of the opening that is widened from the fan shroud wall through the curved portion is set in a range:

$$0<\beta<60°.$$

Due to these specific features, since the airflow path widens through the presence of the curved portion, even though the resistance to airflow is large because the opening in the wall in the airflow downstream side is provided in a protruding manner, the air flow from the fan in the centrifugal direction flows along the inclined face, which is inclined radially outward (centrifugal direction), thus, the air flow resistance is reduced, and it is possible to increase the volume of air moved by the fan.

Moreover, by protrudingly providing the opening in the wall in such a way to widen diameter, interference of the fan with the hole periphery becomes more difficult, and it becomes possible to effectively prevent noise increase caused by fan interference with the hole periphery.

BEST MODE FOR CARRYING OUT THE INVENTION

The following is an explanation of embodiments of the invention, based on the drawings.

First Embodiment

Figure 1:
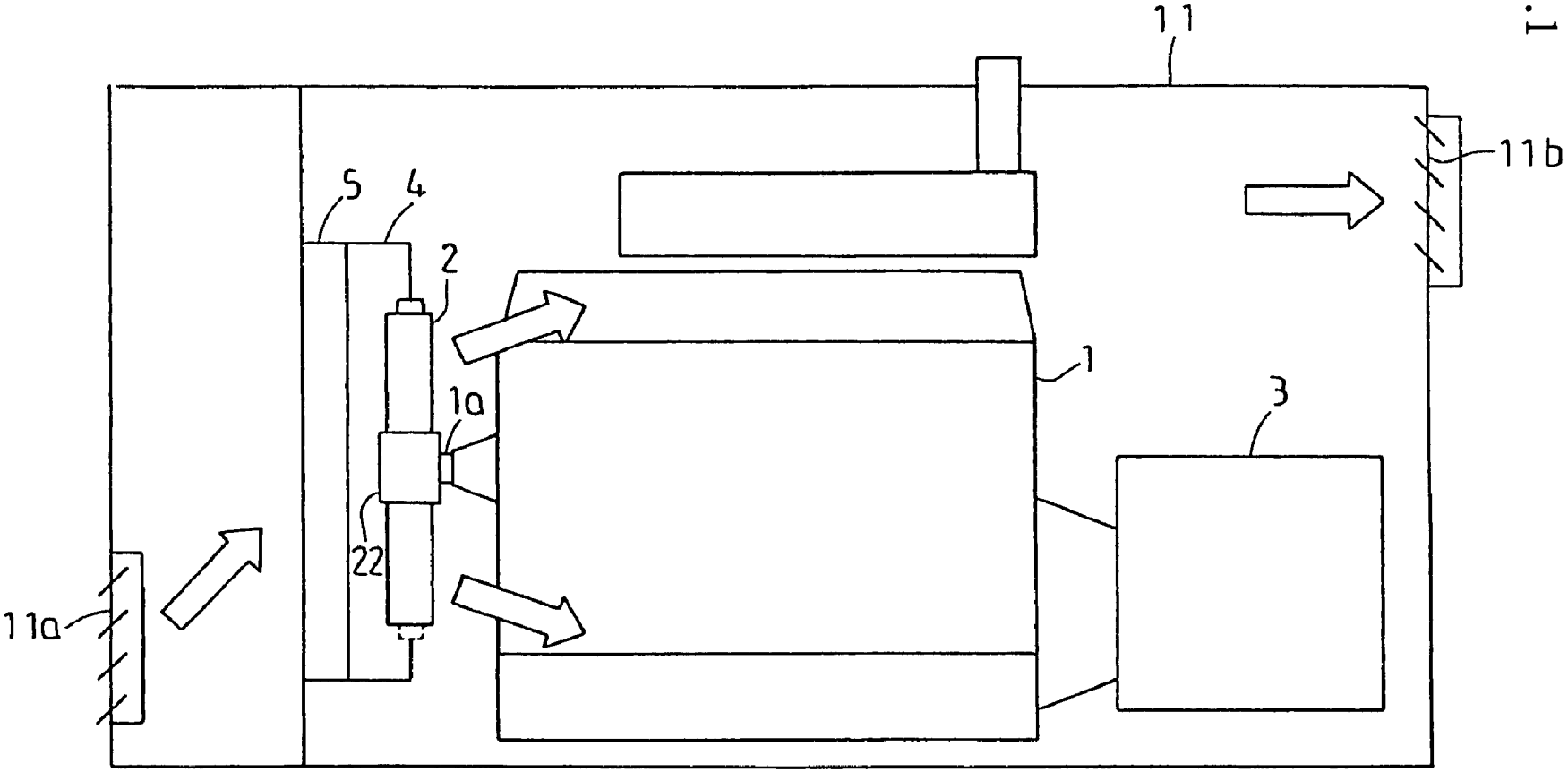
FIG. 1 is diagram that schematically shows an engine cooling device using a radiator fan according to a first embodiment of the present invention.

FIG. 1 is a schematic diagram showing an engine cooling device using a radiator fan according to a first embodiment of the invention, where numeral 1 denotes an engine, numeral 2 denotes a radiator fan (a fan) connected to and rotating together with a crankshaft 1*a* of the engine 1, and numeral 3 denotes a device such as a pump or generator driven by motive power received through an output shaft (not shown) of the engine 1.

The engine 1 is installed inside an engine room 11. The engine room 11 is a space with high airtightness, the front upstream wall of which is provided with an air inlet opening 11*a*, and the rear downstream wall of which is provided an air exhaust opening 11*b*.

Figure 2:
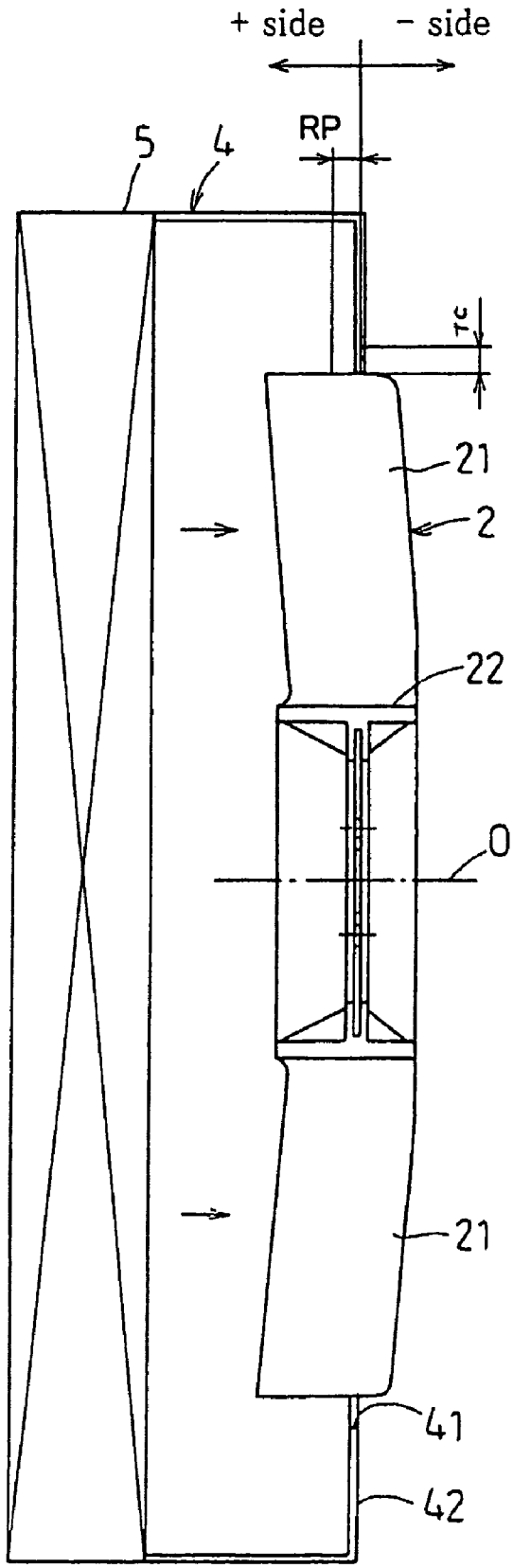
FIG. 2 is a cross section of the fan shroud and the sucking type radiator fan according to the first embodiment, cut in the vicinity of the rotation axis.

Further, as shown in FIG. 2, the radiator fan 2 is accommodated within a fan shroud 4, formed by providing an opening 41, which encompasses the radiator fan 2 outward in a radial direction, in a downstream airflow direction wall 42 (shown on the right side in the drawing). Still further, providing a radiator 5 on the upstream airflow direction side (marked as +side in the drawing) of the fan shroud 4, a sucking type radiator fan sucking air through the radiator 5 is adopted for the radiator fan 2.

Figure 3:
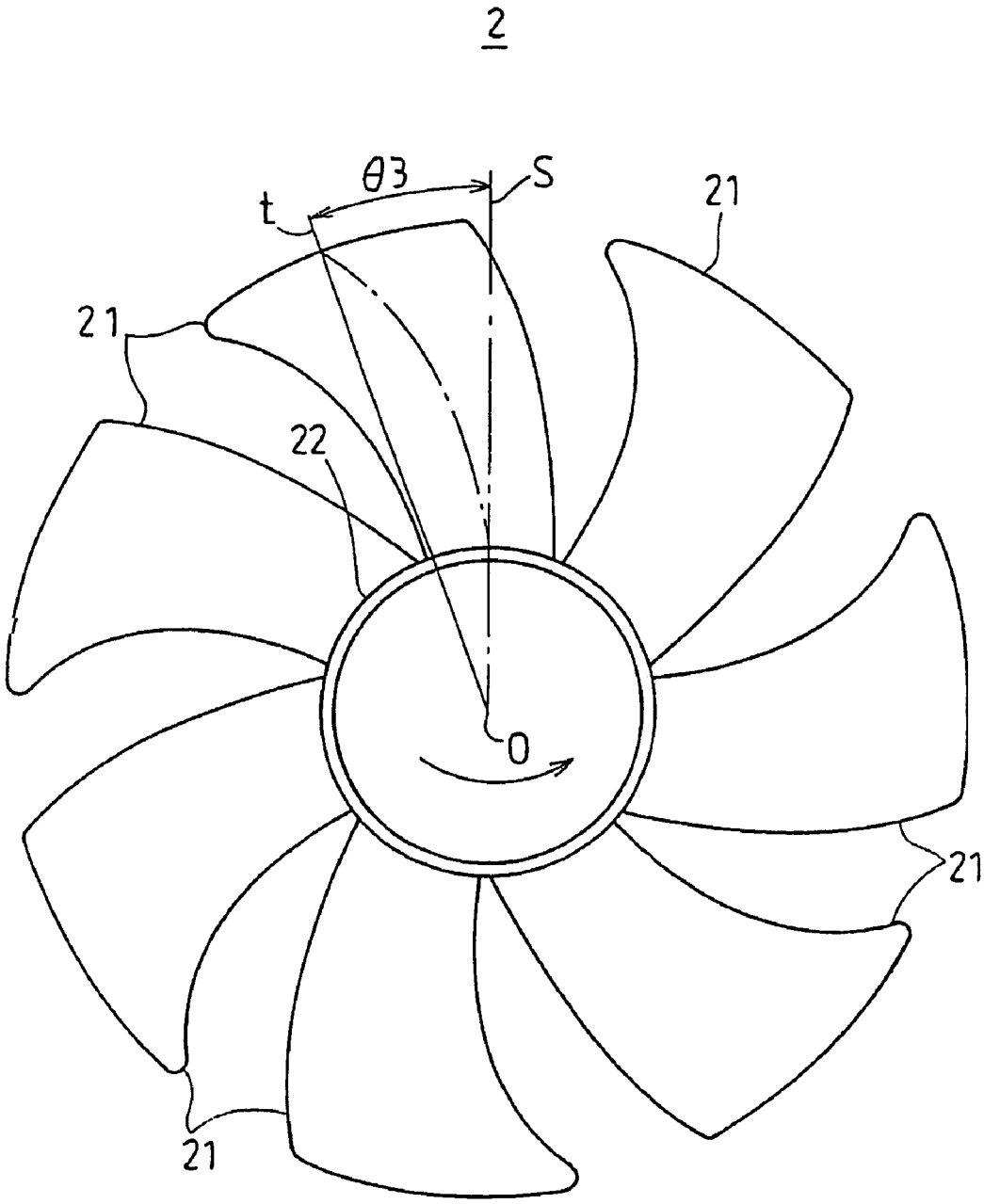
FIG. 3 is a front view of the radiator fan according to the first embodiment.

As shown in FIG. 3, the radiator fan 2 is made of seven propeller blades 21 mounted onto a boss 22, in order to force airflow into the engine room 11.

A detailed description of the structure of the radiator fan 2 and the fan shroud 4 is given as follows.

Structure of the Radiator Fan 2

Figure 4:
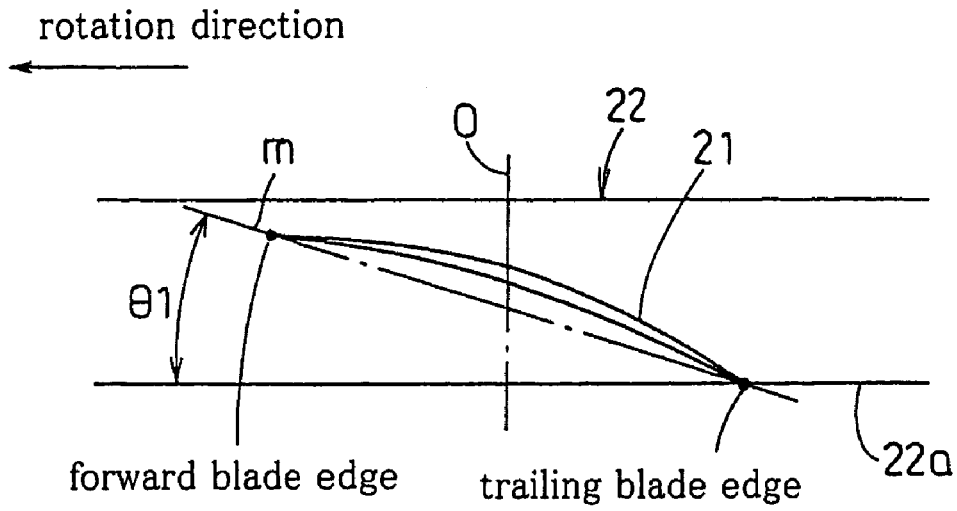
FIG. 4 is a cross section showing the attachment angle θ1 at the propeller blade base portion according to the first embodiment.

An attachment angle θ1 at the propeller blade base portion projected onto a plane that is parallel to the attachment face of the row of propeller blades 21 to the boss 22, in other words, as shown in FIG. 4, an inclination angle θ1 (attachment angle θ1) between a straight line m connecting a forward blade edge and a trailing blade edge at the propeller blade base portion, and an end face 22*a* of the boss 22 that is perpendicular to the rotation axis o, is set to a range of 35° and 45°. This is because, if the attachment angle θ1 (inclination angle θ1) at the propeller blade base portion is set to an angle greater than 45°, the portion of the airflow flowing in the direction of the rotation axis o increases, and airflow in the centrifugal direction cannot be generated. On the other hand, if the attachment angle θ1 is set to less than 35°, the portion of the airflow flowing in the direction of the rotation axis o is reduced, and too much airflow is generated in the centrifugal direction. Due to this, the attachment angle θ1 at the propeller blade base portion is set to an angle in the range of 35° to 45°, allowing generation of airflow in the centrifugal direction, and allowing air received at the base of the blades to be guided smoothly to the propeller blade base portion.

Figure 5:
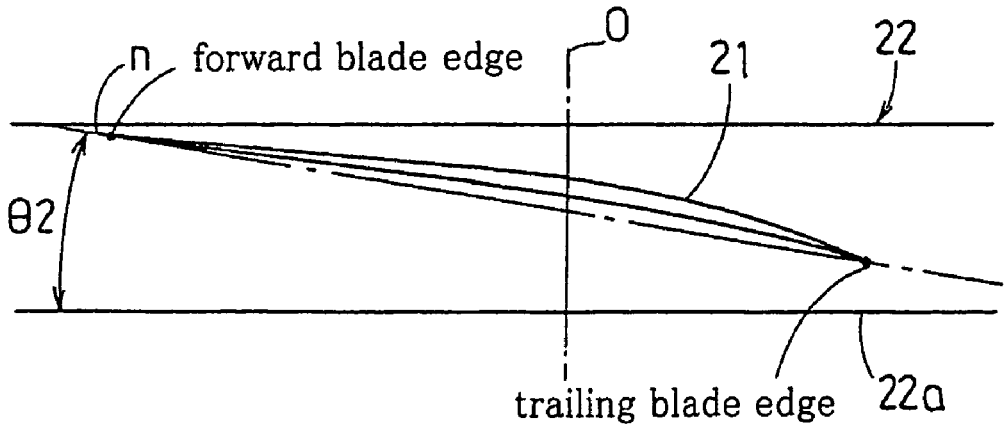
FIG. 5 is a cross section showing the attachment angle θ2 at the propeller blade tip portion according to the first embodiment.

On the other hand, as shown in FIG. 5, an attachment angle θ2 of a propeller blade tip portion, that is, an inclination angle θ2 between a straight line n connecting the forward blade edge and the trailing blade edge at the propeller blade tip portion, and the end face 22*a* of the boss 22 that is perpendicular to the rotation axis o of the radiator fan 2 is set in a range of 15° to 22°, which is smaller than the attachment angle θ1 at the propeller blade base portion (35° to 45°). If the attachment angle θ2 at the propeller blade tip portion is set at an angle greater than 22°, the volume of airflow in the direction of the rotation axis is large, however the flow may easily delaminate. On the contrary, if the attachment angle θ2 is set at less than 15°, flow delamination will be less likely, but the volume of airflow in the direction of the rotation axis will be less. Consequently, by setting the attachment angle θ2 of the propeller blade tip portion to the range of 15° to 22°, the volume of airflow in the rotation axis direction can be maintained, and the generation of flow delamination can be reduced.

Further, the seven propeller blades 21, a chord length Ct at the propeller blade tip portion, and a circumferential length π×Df of the propeller blades 21 are set such that they satisfy the following relationship:

$$0.65<7\times Ct/(\pi\times Df)<0.85$$

This is in order to set the value {7Ct/(π×Df)} obtained by dividing the sum (7Ct) of the chord lengths Ct of the seven propeller blades 21 at the propeller blade tip portion by the value of the circumferential length π×Df of the propeller blades 21 to the optimum value. If 7Ct/(π×Df) is less than 0.65, then the blade area of the propeller blades 21 is too small, so that the air will not flow efficiently and static pressure efficiency will be reduced. On the other hand, if 7Ct/(π×Df) is greater than 0.85, then the load per blade area will increase, and noise will increase, because the blade area of the propeller blades 21 is too large.

Further, based on the value (Ct/Cb) obtained by dividing the chord length Ct at the propeller blade tip portion by the chord length Cb at the propeller blade base portion, the tip broadening ratio of the propeller blades 21 is set in the range of:

$$Ct/Cb=1.5 \text{ to } 2.1.$$

This is because, rather than an increase at the propeller blade base portion, an increase in blade area at the propeller blade tip portion will increase the airflow efficiency.

Further, as shown in FIG. 3, a sweep angle θ3 with respect to the rotation direction of the radiator fan 2, which is the angle defined by a line s passing through the rotation axis o of the radiator fan 2 and bisecting the chord Cb at the propeller blade base portion, of each propeller blade 21, and a line t passing through the rotation axis o and bisecting the chord Ct at the propeller blade tip portion, is set in the range 15° to 25°. This is because increasing the sweep angle reduces noise, so that it is advantageous with regard to lowering noise.

Still further, the forward blade edge of each propeller blade 21 is curved at substantially the same curvature from the propeller blade base portion through to the propeller blade tip portion. Also the trailing blade edge is curved at substantially the same curvature from the propeller blade base portion through to the propeller blade tip portion.

Structure of the Fan Shroud 4

As shown in FIG. 2, an overlap position at which the propeller blade tip portion of the radiator fan 2 overlaps in the direction of the rotation axis o with the airflow direction upstream wall 42 (right end in the drawing) is set within a range of $$-0.02<RP/Df<0.08$$

in terms of a distance RP in the direction of the rotation axis o between the center of the propeller blade tip portion of the radiator fan 2 with respect to the direction of the rotation axis o and the airflow direction upstream wall 42 of the fan shroud 4, with respect to the diameter Df of the radiator fan.

Figure 6:
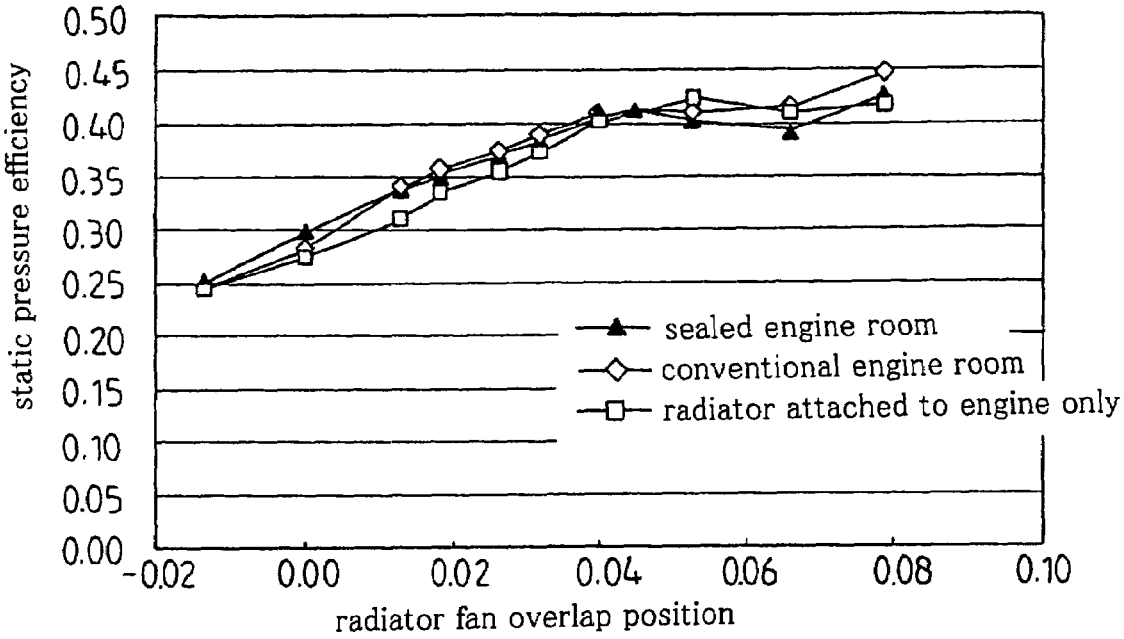
FIG. 6 is a diagram showing the characteristics of static pressure efficiency as a function of the radiator fan overlap position, at each of the conditions of a sealed engine room according to the first embodiment, a conventional engine room, and a fan simply attached to an engine.
Figure 7:
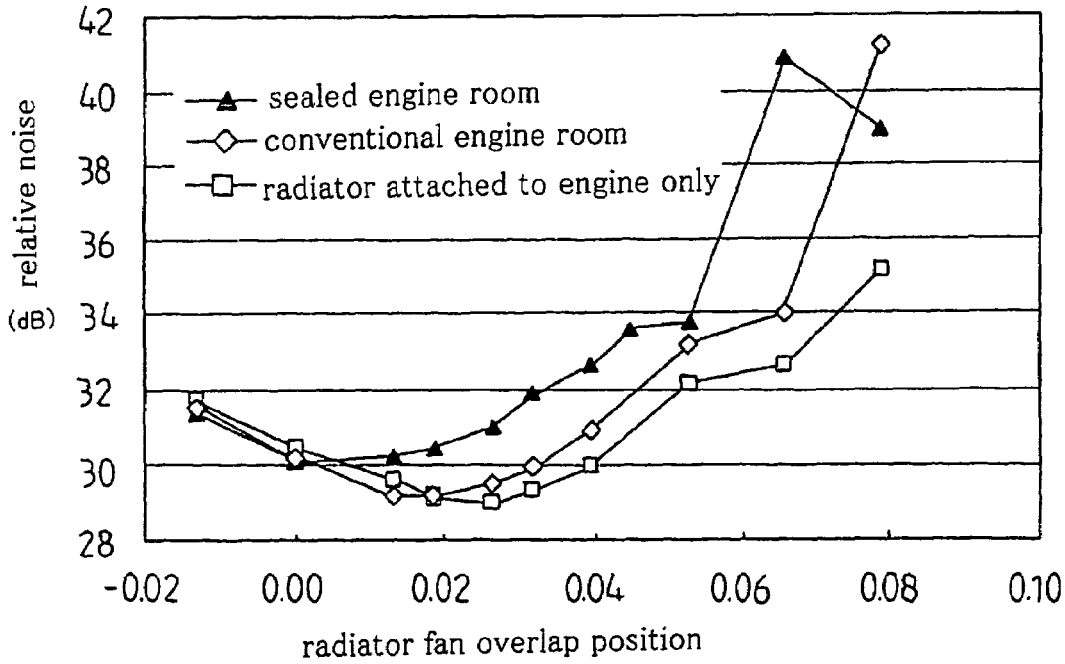
FIG. 7 is a diagram showing the characteristics of relative noise as a function of the radiator fan overlap position, at each of the conditions of a sealed engine room according to the first embodiment, a conventional engine room, and a fan simply attached to an engine.

When, as shown in FIG. 6, the overlap position (RP/Df) of the propeller blade tip portion with respect to the airflow direction upstream wall 42 of the fan shroud 4 is in a range larger than −0.02 and smaller than 0.08, and when a comparison is made between the highly airtight engine 1 shown in FIG. 1, an engine having a conventional large air intake opening on the upstream side of the radiator fan, and an engine provided only with a radiator on the upstream side of the radiator fan, then the static pressure efficiency is substantially the same, but as shown in FIG. 7, a difference in relative noise results, and so from this standpoint the overlap position (RP/Df) is set to the range larger than −0.02 and smaller than 0.08. In view of relative noise, it is thus preferable to set the overlap position (RP/Df) in the range of −0.02<RP/Df<0.08.

If static pressure is P(Pa), flow is Q($m^3$/s) and fan power is W(w), then the static pressure efficiency of the radiator fan airflow, as given on the vertical axis of FIG. 6, can be determined from (P×Q)/W (dimensionless). In other words, it is a measure of how much flow (static pressure, flow rate) can be generated from the fan driving power. Consequently, when the static pressure efficiency is higher, a higher static pressure can be generated from a given fan driving power, and a larger flow rate may also be generated. Conversely, it is sufficient to use a lower fan driving power to generate the same flow (with the same static pressure and flow rate). In the following diagrams, the definition of static pressure efficiency is the same, so will not be further explained.

Further, a radial gap TC between the opening 41 of the airflow direction upstream wall 42 in the fan shroud 4 and the propeller blade tip portion of the radiator fan 2 is set such that the following relationship with the diameter Df of the radiator fan 2 is satisfied:

$$0<TC/Df<0.15$$

Figure 8:
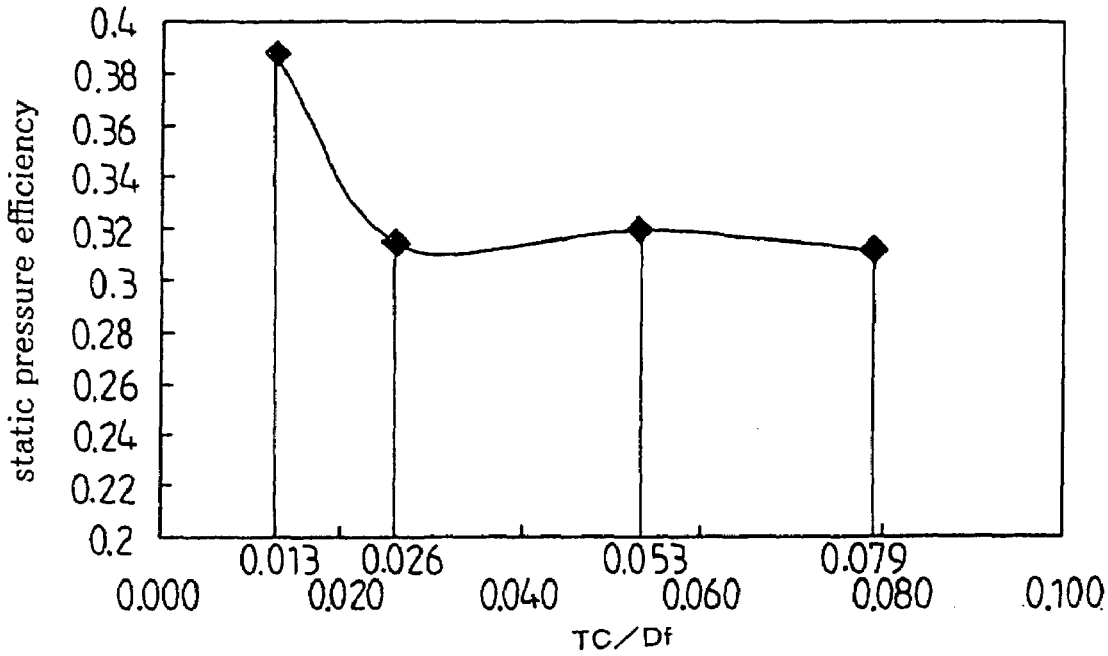
FIG. 8 is a diagram showing the characteristics of static pressure efficiency as a function of the gap between the opening and the radiator fan according to the first embodiment.
Figure 9:
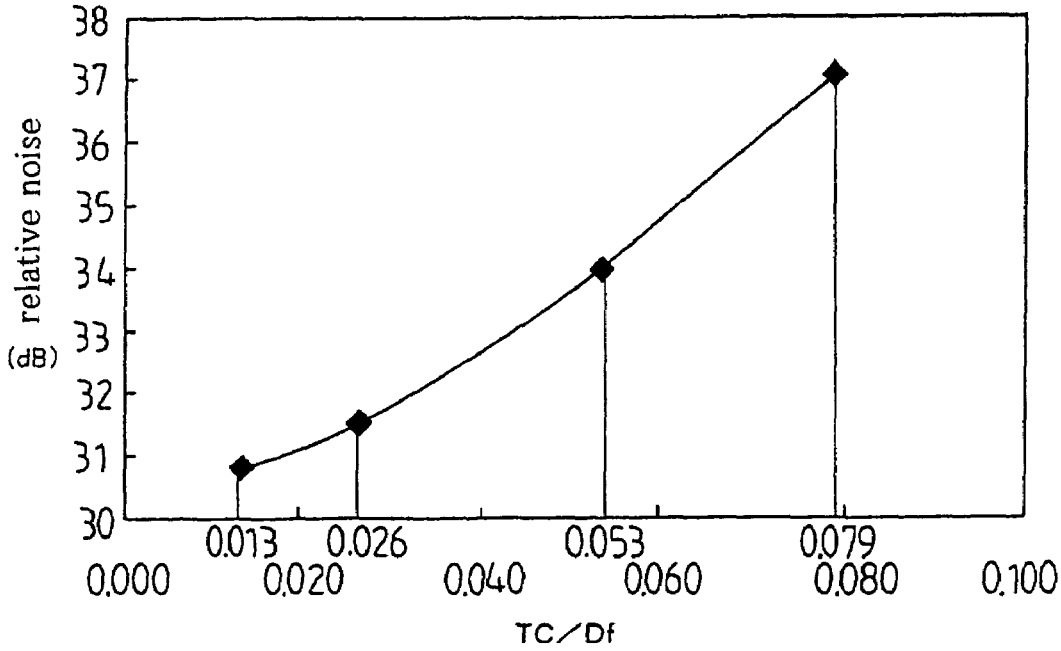
FIG. 9 is a diagram showing the characteristics of relative noise as a function of the gap between the opening and the radiator fan according to the first embodiment.

As shown in FIG. 8, if a comparison is made between 0.013, 0.026, 0.053 and 0.079 as the value (TC/Df) of the gap TC divided by the diameter Df of the radiator fan 2, then the quotient (TC/Df) of 0.013 gives the highest flow efficiency with respect to the airflow coefficient, and, as shown in FIG. 9, gives the lowest relative noise with respect to the airflow coefficient, so with consideration of experimental tolerances, the gap TC is specified to be in the range of 0<TC/Df<0.15.

Figure 10:
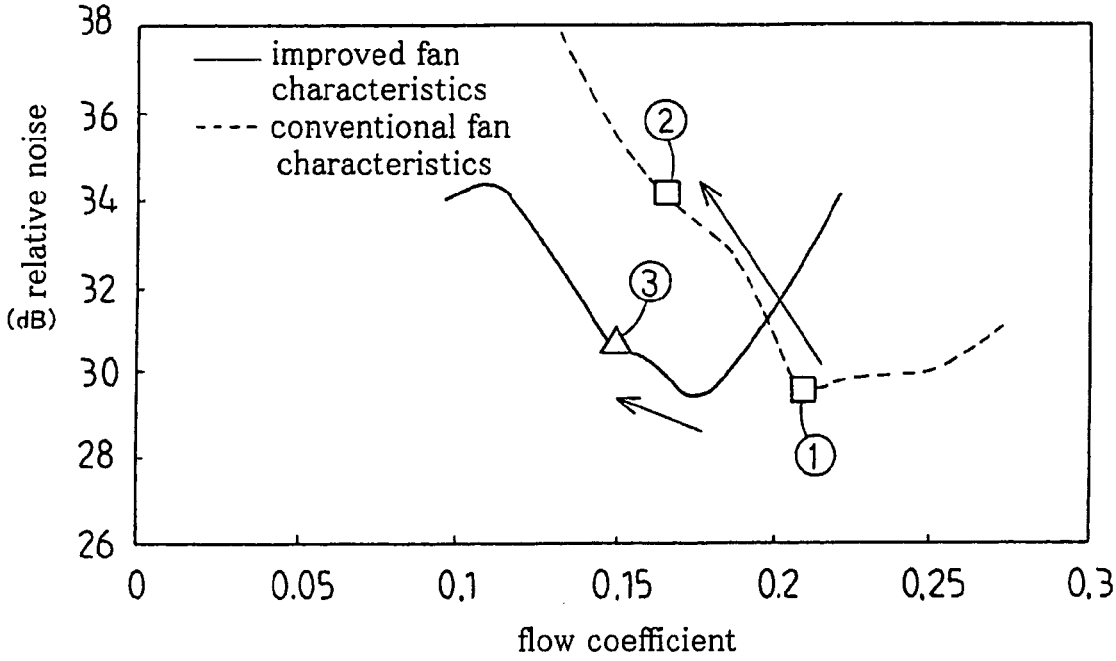
FIG. 10 is a diagram showing the relationship between relative noise and radiator fan flow co-efficient, in the case of the radiator fan of the present embodiment and in the case of the conventional type radiator fan, of the same.
Figure 11:
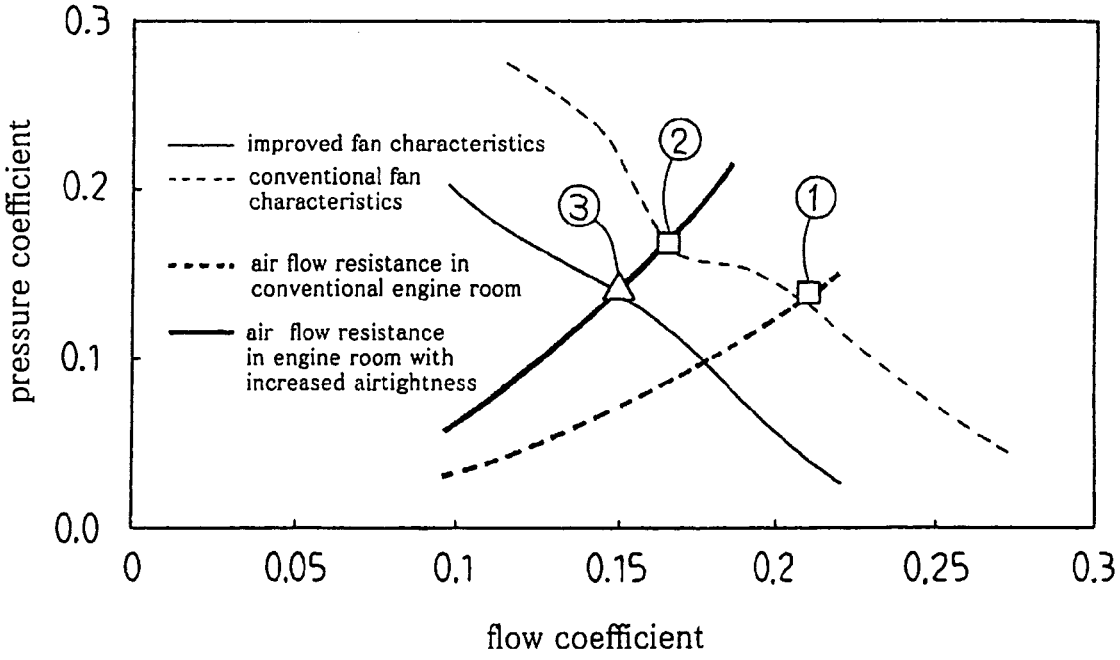
FIG. 11 is a diagram showing the flow characteristics of the radiator fan of this embodiment and a conventional radiator fan, and the characteristics of flow resistance in the sealed type engine room and in the conventional type engine room.

Consequently, in the first embodiment, since the attachment angle θ1 of the propeller blade base portion of each propeller blade 21 is set in the range of 35° to 45°, an airflow in the centrifugal direction may be generated, and air received at the blade base may be smoothly guided to the propeller blade base portion. Further, since the attachment angle θ2 of the propeller blade tip portion is set in the range of 15° to 22°, which is smaller than the attachment angle θ1 (35° to 45°) at the propeller blade base portion, airflow in the direction of the rotation axis can be ensured, and delamination of airflow can be impeded. Still further, since the value {7Ct/(π×Df)} obtained by dividing the product of the seven chord lengths Ct of the propeller blades 21 at the propeller blade tip portion by the circumferential length π×Df of the propeller blades 21 is set at a value greater than 0.65 and less than 0.85, a sufficiently large blade surface area of the propeller blades 21 can be ensured, and the load on the blade surface of propeller blades 21 can be reduced, which is advantageous with regard to reducing noise. Further again, the tip broadening ratio of the propeller blades 21 is set in the range of 1.5 to 2.1, increasing the area of the propeller blade tip portions over that of the propeller blade base portions, and increasing airflow efficiency. Still further again, the sweep angle θ3 with respect to the rotation direction of radiator fan 2 is set in the range of 15 to 25 deg, which is particularly advantageous with regard to reducing noise. In other words, in the engine room 11 with increased airtightness, preventing leakage of noise to the outside, as shown in FIG. 11, even if there is a change in the resistance to airflow in the engine room 11 (as given by thick line in FIG. 11), in this embodiment, the operating point will move from intersection point (2) on the conventional fan characteristic curve (dotted thin line in FIG. 11) to intersection point (3) on the improved fan characteristic curve (thin solid line in FIG. 11). As is shown in FIG. 10, relative noise at intersection point (3) is significantly less, and a reduction of both engine noise and fan noise can be achieved.

Further, from the propeller blade base portion, through to the propeller blade tip portion, the curvatures of the forward blade edge and trailing blade edge of the propeller blades 21 are substantially the same, so even if the size of the radiator fan is changed in accordance with application parameters, such as the size of the engine, or if the diameter Df of the radiator fan 2 is changed because of a change in circumference, there will be no worsening of the performance of the fan, the static pressure efficiency of the airtight engine room 11 can be maintained, and noise reduction of the radiator fan 2 may be realized.

Still further, the overlap position of the propeller blade tip portion of the radiator fan 2 with respect to the airflow direction upstream face of the fan shroud 4 is set at an optimum value greater than −0.02 and less than 0.08, based on the value (TC/Df) obtained by dividing the distance RP in the direction of the rotation axis o between the center of the propeller blade tip portion of the radiator fan 4 with respect to the direction of the rotation axis o and the airflow direction upstream wall of the fan shroud 4 by the diameter Df of the radiator fan. Therefore, airflow through the fan shroud 4 can be facilitated and air volume increased, and by removing obstructions to airflow through the fan shroud 4, a reduction in noise is possible.

Moreover, the value obtained by dividing the gap TC between the opening 42 and the propeller blade tip portion by the diameter Df of the radiator fan 2 is set to a very small value, greater than 0 but less than 0.15, effectively increasing the static pressure efficiency and reducing the noise of the radiator fan 2. Furthermore, vibratory contact due to indirect linking between the radiator fan 2 that is linked to the engine 1 attached to the body via vibration isolating rubber in the engine room 11 and the fan shroud 4 that is attached to the body can be effectively avoided.

Figure 12:
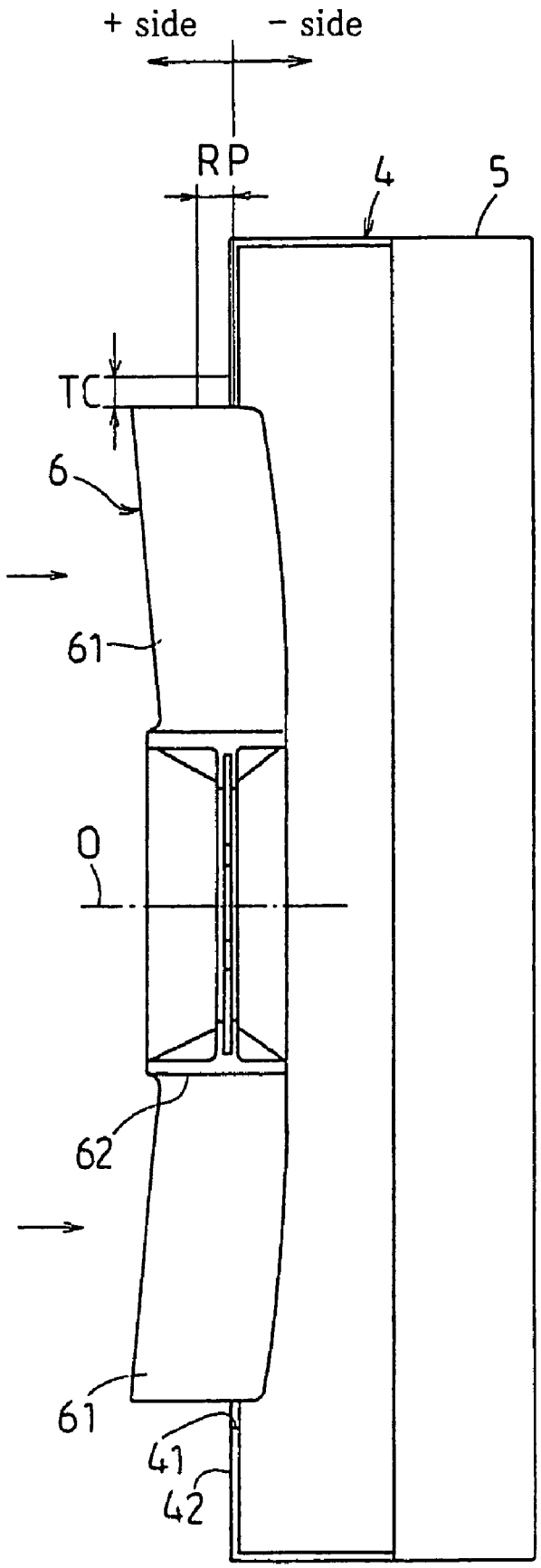
FIG. 12 is a cross section of the blowing type radiator fan and the fan shroud, cut in the vicinity of the rotation axis, according to a modified example of the first embodiment.

It should be noted that, in this first embodiment, a sucking type radiator fan 2 sucking air into the engine room 11 via the radiator 5 has been applied as the radiator fan 2, however, as shown in FIG. 12, it is also possible to use, as the radiator fan 6, a blowing type radiator fan that is provided with a radiator 5 on the downstream side of the airflow direction of the fan shroud 4 (on the right side in the figure) and that blows air through the radiator 5 into the engine room 11. In this case, the radiator fan 6 will be a 7-bladed propeller blade 61 mounted to the boss 62, forcing airflow into the engine room 11.

Second Embodiment

Next, a second embodiment of the invention will be explained, based on FIG. 13 to FIG. 16.

In this embodiment, the structure of the opening of the fan shroud has been changed. Apart from this opening, all other structures are as given in the first embodiment, and given the same symbols, they will not be further explained.

Figure 13:
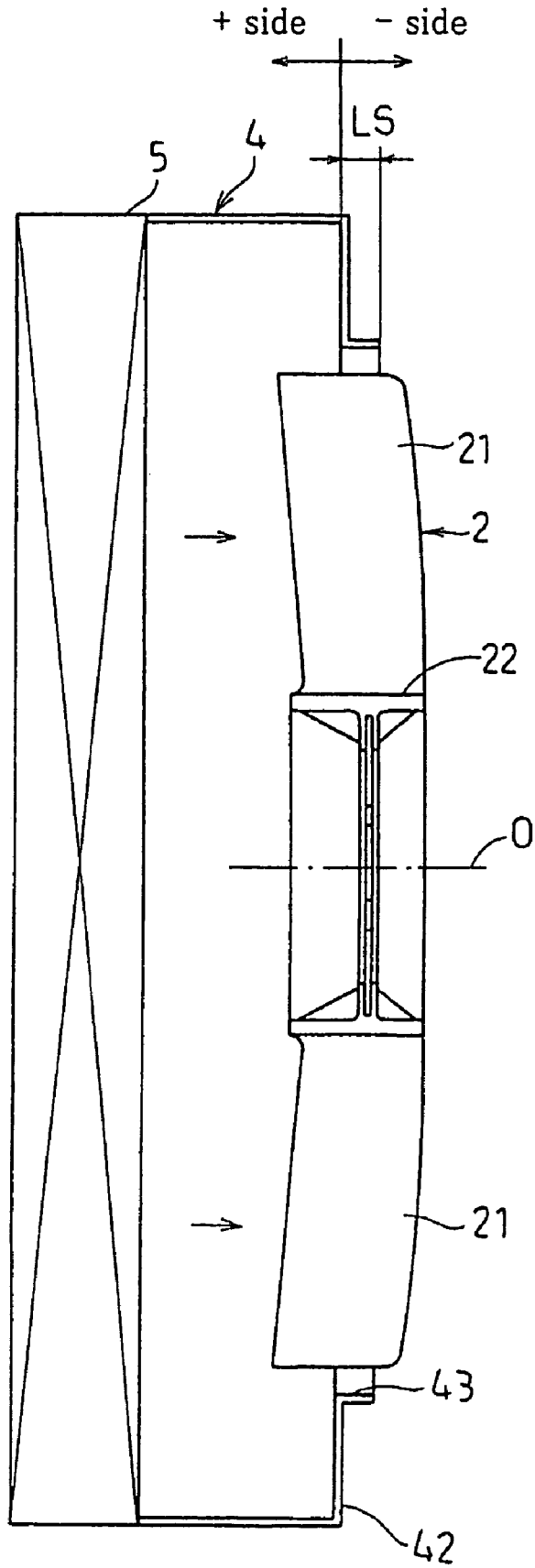
FIG. 13 is a cross section of the sucking type radiator fan and the fan shroud, cut in the vicinity of the rotation axis, according to the second embodiment of the present invention.

That is to say, in this example, as shown in FIG. 13, the opening 43 protrudes straight out at a substantially right angle from the airflow direction upstream wall 42 of the fan shroud towards the airflow direction downstream side (on the right side in the figure). Further, the median position, in the direction of the rotation axis o, of the propeller blade tip portion of the radiator fan 2 is positioned in substantially the same position in relation to the rotation axis o as that of the airflow direction upstream wall 42. Providing the radiator 5 on the upstream side in the airflow direction of the fan shroud 4 (on the left side in the figure), a sucking type radiator fan 2 has been adopted, sucking air through the radiator 5.

And, based on the diameter Df of the radiator fan 2, the protrusion amount LS, which is the amount that opening 43 protrudes from the airflow direction upstream face 42 of the fan shroud 4, is set such as to satisfy the following relationship:

$$0<LS/Df<0.1$$

Figure 14:
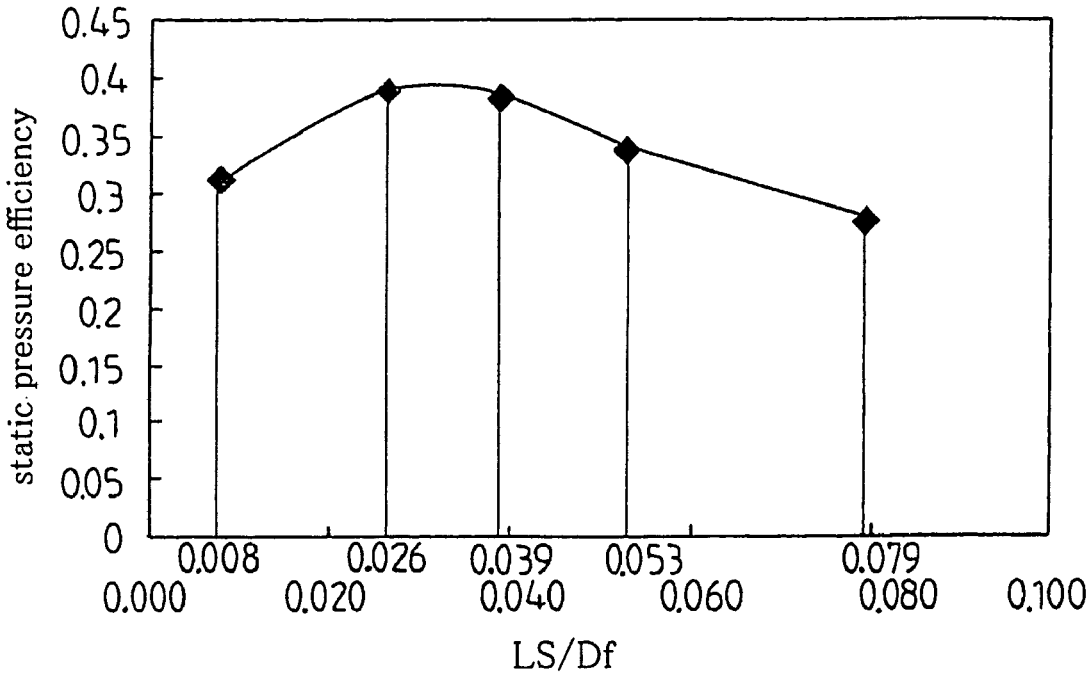
FIG. 14 is a diagram showing the characteristics of static pressure efficiency with change in the protrusion amount of the fan shroud according to the second embodiment.
Figure 15:
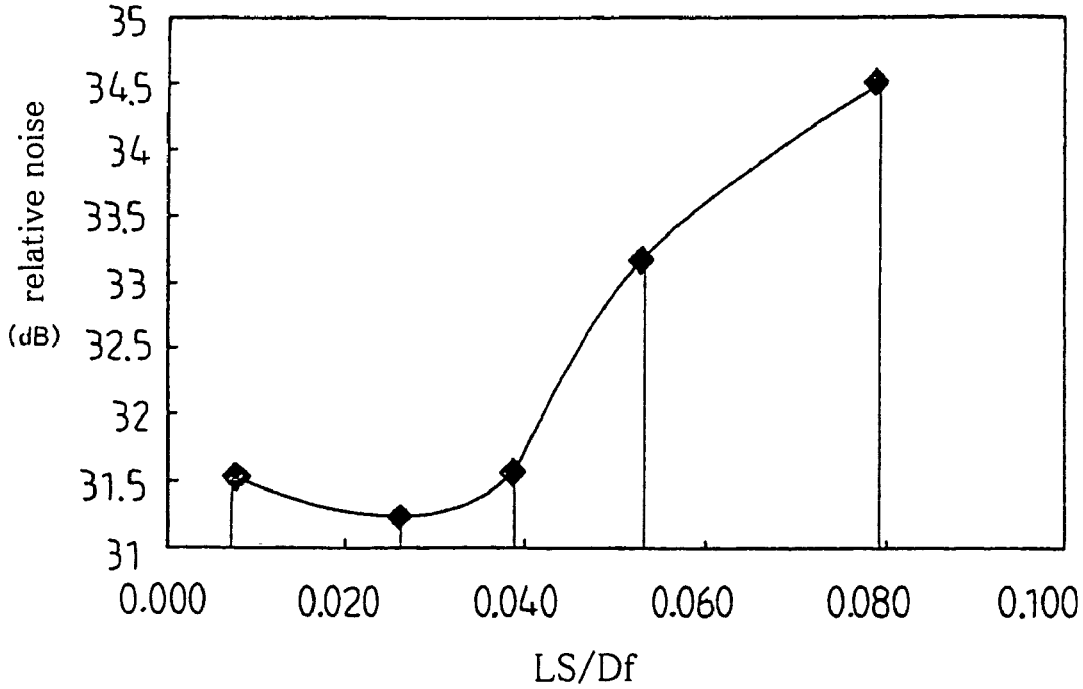
FIG. 15 is a diagram showing the characteristics of relative noise with change in the protrusion amount of the fan shroud according to the second embodiment.

As shown in FIG. 14, when comparing radiator fans in which the value (LS/Df) obtained by dividing the protrusion amount LS of the opening 43 by the diameter Df of the radiator fan 2 takes on the values 0.008, 0.026, 0.039, 0.053 and 0.079, then the radiator fan in which the quotient (LS/Df) is 0.053 shows a trend towards a low flow efficiency with respect to the airflow coefficient, and, as shown in FIG. 15, shows a trend towards a high relative noise with respect to the airflow coefficient, so with consideration of experimental tolerances, the protrusion amount LS of the opening 43 is set to a range of 0<LS/Df<0.1.

Accordingly, in this embodiment, the protrusion amount LS of the opening 43 in the airflow direction upstream wall 42 of the fan shroud 4 is set to an optimum value based on the diameter Df of the radiator fan 2. That is, if the protrusion amount LS of the opening 43 is too large, in addition to the fact that static pressure efficiency cannot be effectively raised due to increased resistance within the tube, there is a risk of increased noise by obstruction of the peripheral rim of the opening 43 by the radiator fan 42. Consequently, setting the protrusion amount LS of the opening 43 to a value greater than 0 and smaller than 0.1, based on the diameter Df of the radiator fan 2, the static efficiency can be effectively increased compared to a radiator fan with a simple opening opened in the airflow upstream side wall of the fan shroud (one in which there is no protruding amount LS), and it is possible to prevent an increase in noise due to the interference of the radiator fan 2 with the peripheral rim of the opening 43.

Figure 16:
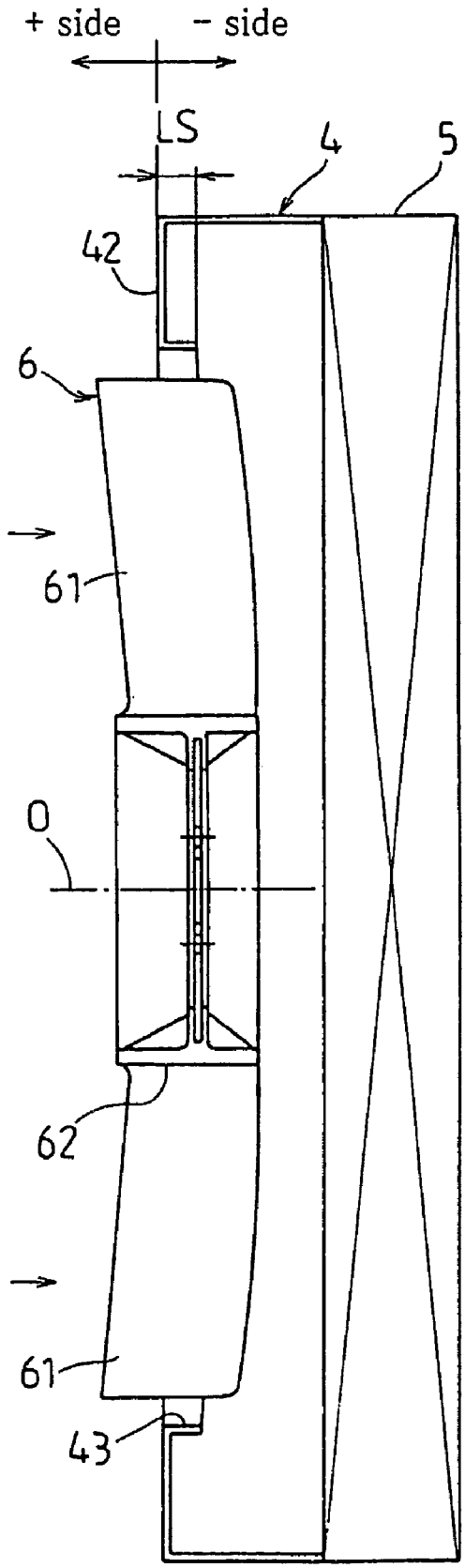
FIG. 16 is a cross section of the blowing type radiator fan and the fan shroud, cut in the vicinity of the rotation axis, according to a modified example of the second embodiment.

It should be noted that, in this second embodiment, a sucking type radiator fan sucking air into the engine room 11 via the radiator 5 has been applied as the radiator fan 2, however, as shown in FIG. 16, it is also possible to use, as the radiator fan 6, a blowing type radiator fan 6 that is provided with a radiator 5 on the downstream side of the airflow direction of the fan shroud 4 (on the right side in the figure) and that blows air through the radiator 5 into the engine room 11.

Third Embodiment

Next, a third embodiment of the invention will be explained, based on FIG. 17 to FIG. 20.

In this embodiment, the structure of the opening of the fan shroud is changed. Apart from this opening, all other structures are as given in the first embodiment, and given the same symbols, they will not be further explained.

Figure 17:
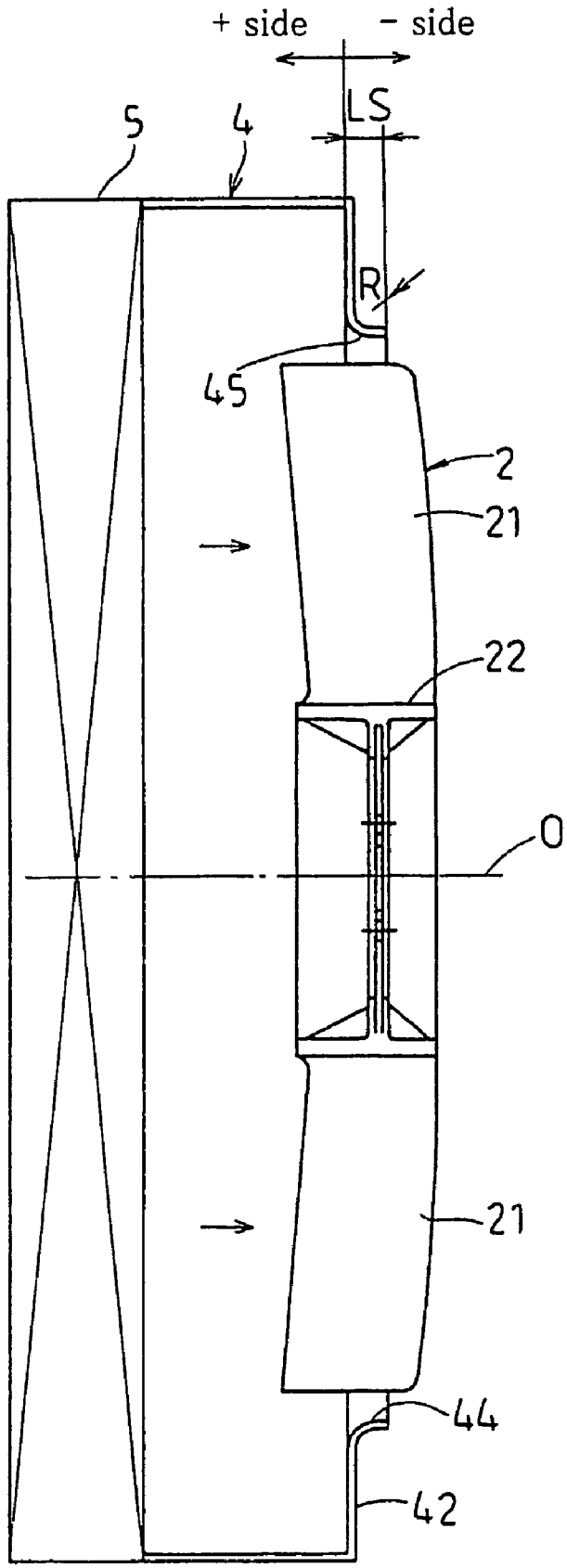
FIG. 17 is a cross section of the sucking type radiator fan and the fan shroud, cut in the vicinity of the rotation axis, according to the third embodiment of the present invention.

That is to say, in this example, as shown in FIG. 17, an opening 44 protrudes straight out at a substantially right angle, with a curved portion 45, from the airflow direction upstream wall 42 of the fan shroud 4 toward the airflow direction downstream side. Further, the median position, in the direction of the rotation axis o, of the propeller blade tip portion of radiator fan 2 is positioned in substantially the same position in relation to the rotation axis o as that of the airflow direction upstream wall 42. Providing the radiator 5 on the upstream side (on the left side in the figure) in the airflow direction of the fan shroud 4, a sucking type radiator fan 2 has been adopted, sucking air through the radiator 5.

Based on the diameter Df of radiator fan 2, a radius R of the curved portion 45 in the airflow direction upstream side of the fan shroud 4 is set such as to satisfy the relationship:

$$0<R/Df<0.1$$

Figure 18:
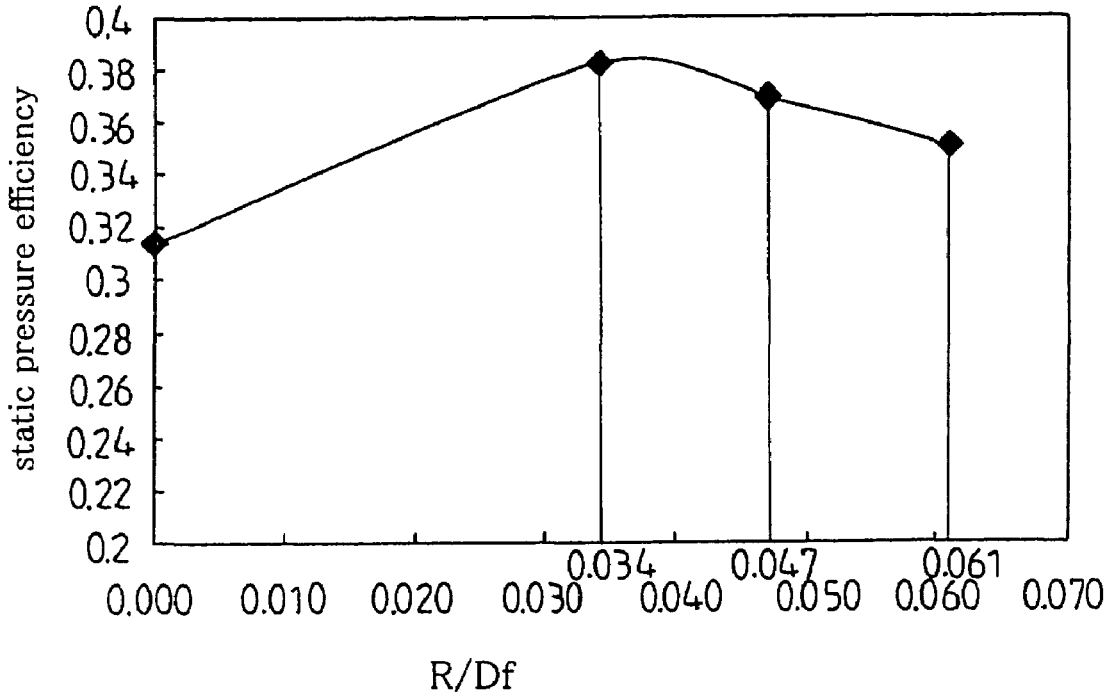
FIG. 18 is a diagram showing the characteristics of static pressure efficiency with a different radius of the curved section of the fan shroud according to the third embodiment.
Figure 19:
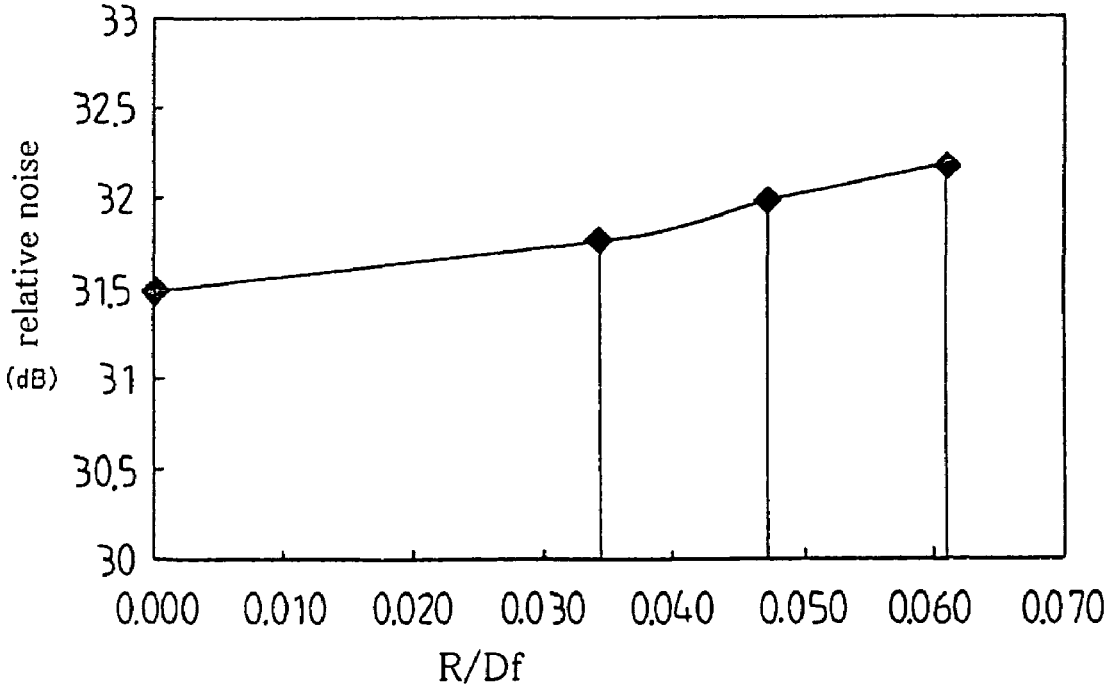
FIG. 19 is a diagram showing the characteristics of relative noise as a function of the radius of the curved section of the fan shroud according to the third embodiment.

As shown in FIG. 18, when comparing radiator fans in which the value (R/Df) obtained by dividing the radius R of the curved portion 45 by the diameter Df of the radiator fan 2 takes on the values 0, 0.034, 0.047, and 0.061, then the radiator fan in which the quotient is 0.061 shows a trend towards a poorer flow efficiency with respect to airflow coefficient, and, as shown in FIG. 19, shows a trend towards a higher relative noise with respect to airflow coefficient, so with consideration of experimental tolerances, the radius R of the curved portion 45 is set to a range of 0<R/Df<0.1.

Accordingly, in this embodiment, with respect to the opening 44 that protrudes at a substantially right angle in the down stream airflow direction, the air inflow is smoothed by lowering the inflow resistance with the curved portion 45 in the airflow direction upstream wall 42 of the fan shroud 4, making it possible to increase the flow quantity of the radiator fan 2.

Figure 20:
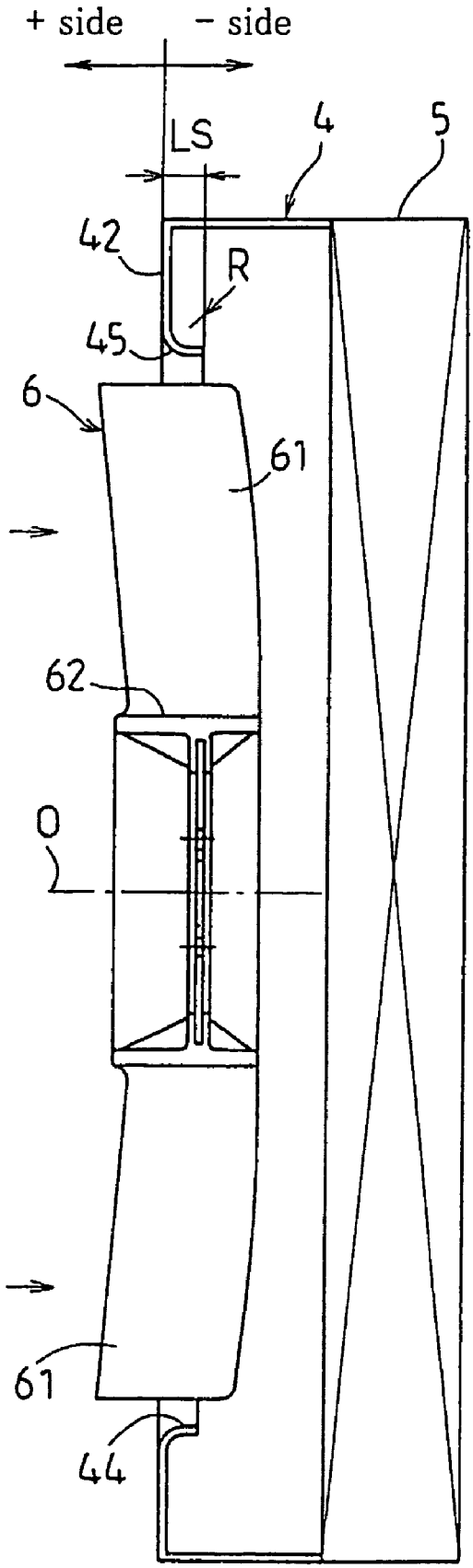
FIG. 20 is a cross section of the blowing type radiator fan and the fan shroud, cut in the vicinity of the rotation axis, according to a modified example of the third embodiment.

It should be noted that in this third embodiment, a sucking type radiator fan sucking air into the engine room 11 via the radiator 5 has been applied as the radiator fan 2, however, as shown in FIG. 20, it is also possible to use, as the radiator fan 6, a blowing type radiator fan 6 that is provided with a radiator 5 on the downstream side of the airflow direction of the fan shroud 4 (on the right side in the figure) and that blows air through the radiator 5 into the engine room 11.

Fourth Embodiment

Next, a fourth embodiment of the invention will be explained, based on FIG. 21.

In this embodiment, the structure of the opening of the fan shroud is changed. Apart from this opening, all other structures are as given in the third embodiment, and given the same symbols, they will not be further explained.

Figure 21:
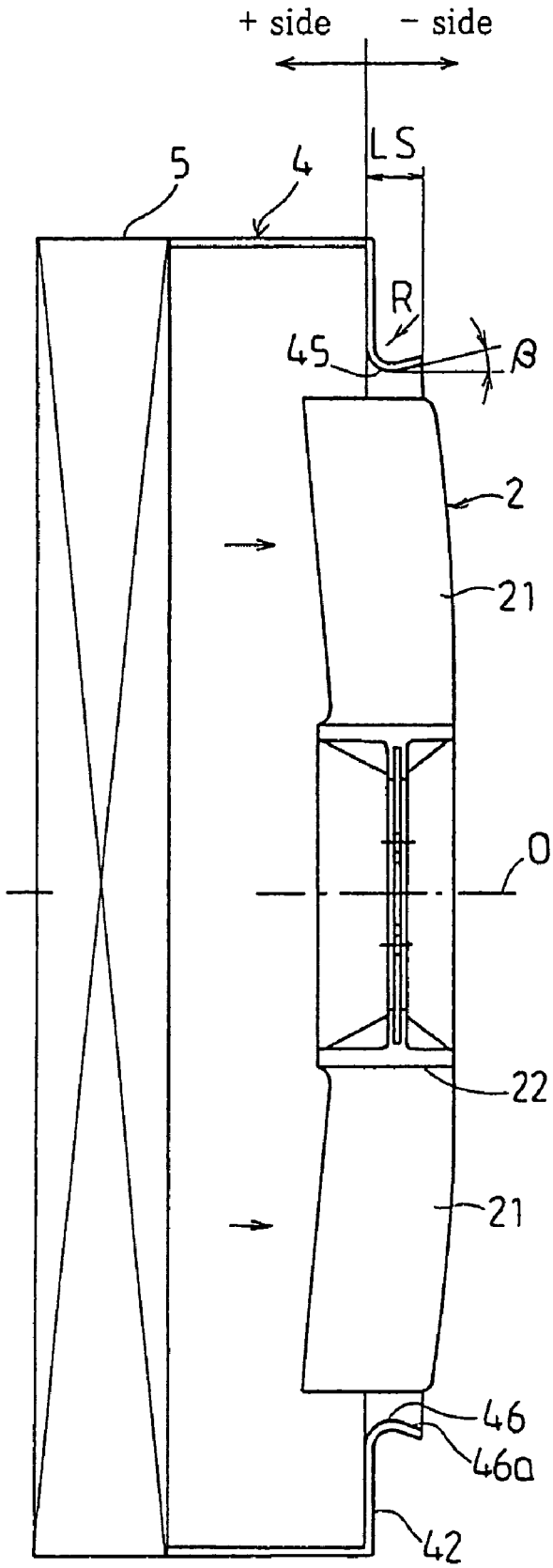
FIG. 21 is a cross section of the sucking type radiator fan and the fan shroud, cut in the vicinity of the rotation axis, according to the fourth embodiment of the present invention.

That is to say, in this example, as shown in FIG. 21, an opening 46 protrudes out such that its diameter is widened with the curved portion 45 toward the airflow direction downstream side, with respect to the airflow direction upstream wall 42 of the fan shroud 4. Further, the median position, in the direction of the rotation axis o, of the propeller blade tip portion of radiator fan 2 is positioned in substantially the same position in relation to the rotation axis o as that of the airflow direction upstream wall 42. Providing the radiator 5 on the upstream side (on the left side in the figure) in the airflow direction of the fan shroud 4, a sucking type radiator fan 2 has been adopted, sucking air through the radiator 5.

An angle β defined by the rotation axis o of the radiator fan 2 and an inclined face 46*a* of the opening 46 that widens from the airflow direction upstream wall 42 of the fan shroud 4 through the curved portion 45, is set in a range of:

$$0<\beta<60 \text{ deg}$$

Accordingly, in this embodiment, even though the flow path resistance to air is large because the opening 46 is provided in a protruding manner in the downstream side of the airflow direction upstream wall, the air path is enlarged through the curved portion 45, such that the airflow in the centrifugal direction due to radiator fan 2 flows along the inclined face 46*a*, which is inclined due to the diameter widening portion in the outward radial direction (the centrifugal direction), air flow path resistance is reduced, and air flow of the radiator fan 2 can be increased.

Moreover, by providing the opening 46, protruding in such a way that the diameter widens from the airflow direction upstream wall 42 of the fan shroud 4, the radiator fan 2 is less likely to interfere with the peripheral rim of the opening 46, and it is possible to effectively prevent an increase in noise caused by the radiator fan 2 interfering with the peripheral rim of the opening 46.

Figure 22:
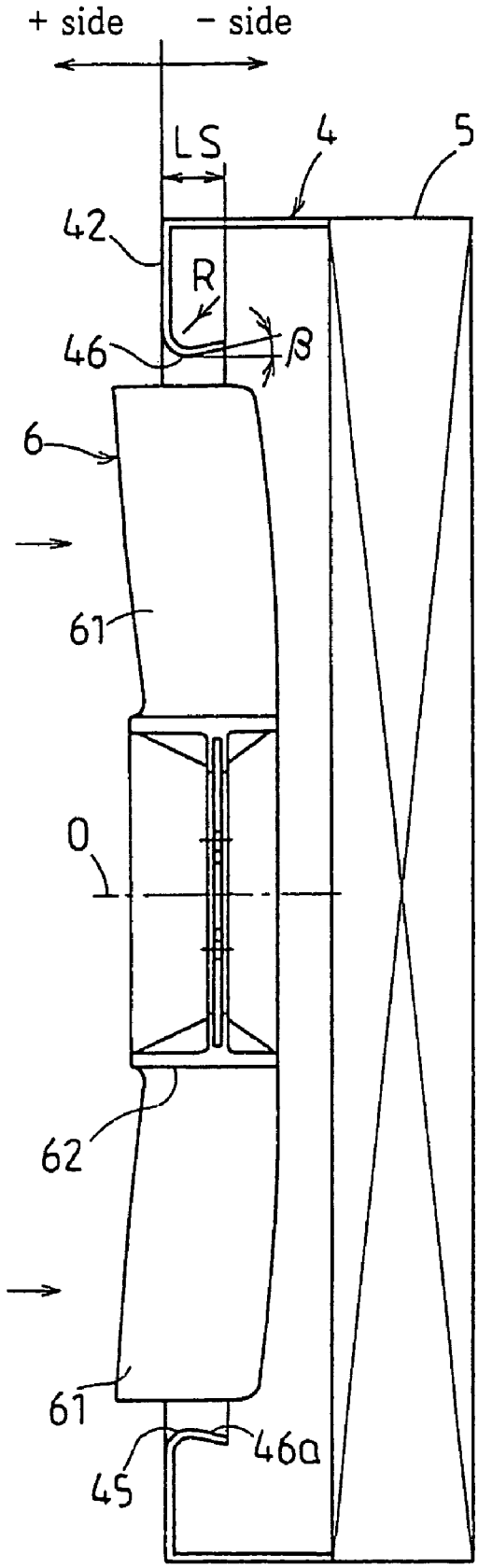
FIG. 22 is a cross section of the blowing type radiator fan and the fan shroud, cut in the vicinity of the rotation axis, according to a modified example of the fourth embodiment.

It should be noted that in this fourth embodiment, a sucking type radiator fan sucking air into the engine room 11 via the radiator 5 has been applied as the radiator fan 2, however, as shown in FIG. 22, it is also possible to use, as the radiator fan 6, a blowing type radiator fan 6 that is provided with a radiator 5 on the downstream side of the airflow direction of the fan shroud 4 (on the right side in the figure) and that blows air through the radiator 5 into the engine room 11.

OTHER EMBODIMENTS

It should be noted that although in the above embodiments, the forward blade edge and the trailing blade edge of each of the propeller blades 21 have been curved to substantially the same curvature from the propeller blade base portion to the propeller blade tip portion, it is also possible to curve only the forward blade edge of each blade to substantially the same curvature from the propeller blade base portion to the propeller blade tip portion. Even in this case, if the diameter of the radiator fan is changed by a cut along the circumference, there will be no worsening of fan performance, and in addition to maintaining the static pressure efficiency with respect to the highly airtight engine room, it is possible to translate into practice the noise reduction due to the radiator fan.

INDUSTRIAL APPLICABILITY

As explained above, the radiator fan according to the present invention is particularly useful for engine rooms of high airtightness, it can suppress the generation of engine and fan noise when used in such an engine room, an engine cooling device using this radiator fan can effectively increase static pressure efficiency, and in addition to reducing fan noise, fan airflow can be increased.

The invention claimed is:

1. A radiator fan, in which a plurality of propeller blades are attached to a boss and which forces air flow, wherein an attachment angle θ1 at a propeller blade base portion projected onto a plane parallel to an attachment surface of the propeller blades with respect to the boss is set in a range of 35 to 45 deg, wherein an inclination angle θ2 at a propeller blade tip portion is set in a range of 15 to 22 deg, wherein a number of the propeller blades N, a chord length Ct at the propeller blade tip portion, and an outer circumference length π×Df of the propeller blade are set such as to satisfy a relationship:

$$0.65<N\times Ct/(\pi\times Df)<0.85,$$

wherein a tip broadening ratio of the propeller blades is set to within a range of $$Ct/Cb=1.5 \text{ to } 2.1,$$

based on the chord length Ct at the propeller blade tip portion and a chord length Cb at the propeller blade base portion, and a sweep angle θ3 with respect to a rotation direction of the fan, defined by a line that passes through a rotation axis of the fan and bisects the chord Cb at the propeller blade base portion and a line that passes through a rotation axis of the fan and bisects the chord Ct at the propeller blade tip portion, is set within a range of 15 to 25 deg.

2. The radiator fan according to claim 1, wherein, of a forward blade edge and trailing blade edge of the propeller blades, at least the forward blade edge is curved at a substantially constant curvature from the propeller blade base portion to the propeller blade tip portion.

3. An engine cooling device using the radiator fan according to claim 1, wherein the fan is accommodated within a fan shroud, which is made by providing an opening covering the fan from an outer side in a radial direction in an end wall, wherein an overlap position at which the fan propeller blade tip portion overlaps the fan shroud wall in the rotation axis direction is set in a range:

$$-0{,}02<RP/Df<0.08,$$

based on the fan diameter Df, and a standard distance RP in the rotation axis direction between the fan shroud wall and the median position, in the rotation axis direction, of the propeller blade tip portion of the fan, and wherein a gap TC in radial direction between the opening in the fan shroud wall and the fan propeller blade tip portion is set to a value that satisfies the relationship:

$$0<TC/Df<0.15$$

based on the fan diameter Df.

4. An engine cooling device using the radiator fan according to claim 1, wherein the fan is accommodated within a fan shroud, which is made by providing an opening covering the fan from an outer side in a radial direction in an end wall, the opening protruding at a substantially right angle from the end wall toward the airflow direction downstream side;

wherein a median position in the rotation axis direction of a propeller blade tip portion of the fan is positioned at substantially the same position on the rotation axis as the fan shroud wall, and wherein a protrusion amount LS of the opening in the fan shroud wall is set such as to satisfy a relationship:

$$0<LS/Df<0.1$$

based on the fan diameter Df.

5. An engine cooling device using the radiator fan according to claim 1, wherein the fan is accommodated within a fan shroud, which is made by providing an opening covering the fan from an outer side in a radial direction in an end wall, the opening protruding at a substantially right angle with a curved portion from the end wall toward the airflow direction downstream side;

wherein a median position in the rotation axis direction of a propeller blade tip portion of the fan is positioned at substantially the same position on the rotation axis as the fan shroud wall; and wherein a radius R of the curved portion of the fan shroud wall is set such as to satisfy a relationship:

$$0<R/Df<0.1$$

based on the fan diameter Df.

6. An engine cooling device using the radiator fan according to claim 1, wherein the fan is accommodated within a fan shroud, which is made by providing an opening covering the fan from an outer side in a radial direction in an end wall, the opening protruding with a curved portion and a widening diameter from the end wall toward the airflow direction downstream side;

wherein a median position in the rotation axis direction of a propeller blade tip portion of the fan is positioned at substantially the same position on the rotation axis as the fan shroud wall; and wherein an angle β defined by the rotation axis of the fan, and an inclined face of the opening that is widened from the fan shroud wall through the curved portion is set in a range:

$$0<\beta<60°.$$

* * * * *